US011551511B2

(12) United States Patent
Penacho et al.

(10) Patent No.: US 11,551,511 B2
(45) **Date of Patent: *Jan. 10, 2023**

(54) METHOD OF GAMING, A GAMING SYSTEM AND A GAME CONTROLLER

(71) Applicant: Aristocrat Technologies Australia Pty Limited, North Ryde (AU)

(72) Inventors: Gary Joseph Penacho, Henderson, NV (US); Casey Lyle Condron, Las Vegas, NV (US); Thomas Tuomey, Las Vegas, NV (US); Kurt Larsen, Las Vegas, NV (US); Charles Schotborgh, Las Vegas, NV (US); Adam Pippin, Las Vegas, NV (US); Ryan Shawn Carr, Las Vegas, NV (US)

(73) Assignee: ARISTOCRAT TECHNOLOGIES AUSTRALIA PTY LIMITED, North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/038,170

(22) Filed: Sep. 30, 2020

(65) Prior Publication Data

US 2021/0012610 A1 Jan. 14, 2021

Related U.S. Application Data

(63) Continuation of application No. 14/868,640, filed on Sep. 29, 2015, now Pat. No. 10,803,697.

(30) Foreign Application Priority Data

Sep. 29, 2014 (AU) ..... 2014903918

(51) Int. Cl.
*G07F 17/32* (2006.01)

(52) U.S. Cl.
CPC ..... *G07F 17/3213* (2013.01); *G07F 17/3262* (2013.01); *G07F 17/3267* (2013.01)

(58) Field of Classification Search
CPC .. G07F 17/34; G07F 17/3213; G07F 17/3262; G07F 17/3267
See application file for complete search history.

(56) References Cited

U.S. PATENT DOCUMENTS 6,632,140 B2 * 10/2003 Berman ..... G07F 17/3211 463/20
6,695,696 B1 2/2004 Kaminkow
(Continued)

OTHER PUBLICATIONS

Australian Examination Report for AU2017203238, dated Dec. 11, 2017, 3 pages.

(Continued)

*Primary Examiner* — Malina D. Blaise
(74) *Attorney, Agent, or Firm* — McAndrews, Held & Malloy, Ltd.

(57) ABSTRACT

An electronic gaming machine comprising a video display and a game controller arranged to select a plurality of symbols from a symbol set for display on the video display, evaluate the symbols displayed on the display to determine whether to initiate a symbol lock event, and upon initiating a symbol lock event, identify symbols which contribute to an award configuration, control the display to lock identified symbols, and updating remaining symbols in the display.

20 Claims, 7 Drawing Sheets

(56) References Cited

U.S. PATENT DOCUMENTS 6,866,583 B2 * 3/2005 Glavich ..... G07F 17/34 463/16
7,371,170 B2 5/2008 Cregan
7,819,742 B2 10/2010 Chamberlain
7,896,737 B2 3/2011 Gauselmann
7,959,504 B2 * 6/2011 Baumgartner ..... G07F 17/32 463/20
8,371,928 B2 2/2013 Englman
8,485,885 B2 * 7/2013 Suda ..... G07F 17/34 463/20
8,506,380 B2 8/2013 Hughes
8,517,814 B2 * 8/2013 Visser ..... G07F 17/3267 463/20
8,840,457 B1 9/2014 Basallo
9,165,433 B2 10/2015 Caputo
9,218,705 B2 * 12/2015 Taylor ..... G07F 17/3265
9,449,470 B2 9/2016 Baerlocher
2005/0054436 A1 * 3/2005 Frizzell ..... G07F 17/3265 463/25
2005/0130737 A1 * 6/2005 Englman ..... G07F 17/3244 463/25
2005/0159208 A1 * 7/2005 Pacey ..... G07F 17/3211 463/20
2008/0051179 A1 * 2/2008 Okada ..... G07F 17/32 463/20
2008/0153563 A1 * 6/2008 Englman ..... G07F 17/32 463/16
2008/0242389 A1 * 10/2008 Jackson ..... G07F 17/32 463/13
2009/0239634 A1 9/2009 Nguyen
2011/0111824 A1 * 5/2011 Cuddy ..... G07F 17/3239 463/43
2011/0117989 A1 5/2011 Kennedy
2013/0072286 A1 3/2013 Suda
2013/0184045 A1 7/2013 Vermaak
2013/0260861 A1 10/2013 Vann
2014/0080570 A1 3/2014 Watkins
2014/0087818 A1 3/2014 Garretsen
2014/0121000 A1 * 5/2014 Porter ..... G07F 17/3244 463/20
2014/0221079 A1 8/2014 Rucker
2014/0256402 A1 9/2014 Caputo
2014/0274294 A1 * 9/2014 Baerlocher ..... G07F 17/326 463/20
2014/0357342 A1 12/2014 Elias
2015/0170461 A1 6/2015 Berman
2015/0170462 A1 * 6/2015 Berman ..... G07F 17/34 463/20
2015/0302705 A1 10/2015 Johnson
2016/0027241 A1 1/2016 Jaffe
2016/0063802 A1 3/2016 Rucker
2016/0078711 A1 3/2016 Rucker
2016/0086429 A1 * 3/2016 Inamura ..... G07F 17/326 463/20

OTHER PUBLICATIONS

Notice of Allowance dated Jul. 13, 2020 for U.S. Appl. No. 14/868,640 (pp. 1-11).

* cited by examiner

METHOD OF GAMING, A GAMING SYSTEM AND A GAME CONTROLLER

RELATED APPLICATIONS

This application is a continuation of U.S. patent application Ser. No. 14/868,640, filed Sep. 29, 2015, which claims priority to Australian Provisional Patent Application No. 2014903918, having a filing date of Sep. 29, 2014, each of which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

In electronic gaming systems such as spinning reel or "slot" gaming machines, symbols are selected for display on a display of the machine. The displayed symbols are evaluated to determine whether an award is to be made to a player.

While such gaming systems provide players with enjoyment, a need exists for alternative gaming systems in order to maintain or increase player enjoyment.

BRIEF SUMMARY OF THE INVENTION

In a first aspect, the invention provides an electronic gaming machine comprising:

a video display; and a game controller arranged to select a plurality of symbols from a symbol set for display on the video display:

evaluate the symbols displayed on the display to determine whether to initiate a symbol lock event, and upon initiating a symbol lock event:

identify symbols which contribute to an award configuration;

control the display to lock identified symbols; and, updating remaining symbols in the display.

In an embodiment the symbol lock event is initiated when predefined symbol display positions within the video display display a matching symbol.

In an embodiment the identified symbols contribute at least partially to an award configuration in combination with at least one of the symbols in the predefined symbol display positions.

In an embodiment the game controller further arranged to evaluate the display to determine whether to make an award, and to make any determined award.

In an embodiment the matching symbol is a wild symbol.

In an embodiment the display is a matrix of symbols including rows and columns.

In an embodiment the predefined symbol display positions comprising a single column.

In an embodiment the symbols are positioned on a reel.

In an embodiment the predefined display positions displaying symbols of a reel.

In an embodiment the award configuration is a predefined pattern of symbols within the display.

In an embodiment the game controller generates a symbol lock event at a predefined position in a game sequence, the symbols being updated in a symbol update and the game sequence comprising a predetermined number of symbol updates.

In a second aspect the invention provides a gaming server arranged to communicate with one or more client devices over a communication network comprising:

the gaming server arranged to select a plurality of symbols from a symbol set for display on a client device:

evaluate the symbols for display to determine whether to initiate a symbol lock event, and upon initiating a symbol lock event:

identify symbols which contribute to an award configuration;

lock identified symbols; and, updating remaining symbols for display.

In a third aspect the invention provides a method for use of an electronic gaming server arranged to communicate with one or more client devices over a communication network comprising:

selecting a plurality of symbols from a symbol set for display on a client device:

evaluating the symbols for display to determine whether to initiate a symbol lock event, and upon initiating a symbol lock event:

identifying symbols which contribute to an award configuration;

locking identified symbols; and, updating remaining symbols for display.

In a fourth aspect the invention provides an electronic method of gaming comprising a gaming server machine:

selecting a plurality of symbols from a symbol set for display on a client device:

evaluating the symbols for display to determine whether to initiate a symbol lock event, and upon initiating a symbol lock event:

identifying symbols which contribute to an award configuration;

locking identified symbols; and, updating remaining symbols for display.

In yet another aspect the invention provides a method for use of an electronic gaming server to communicate with one or more client devices over a communication network comprising: selecting a plurality of symbols from a symbol set for display on a client device, evaluating the symbols for display to determine whether to initiate a symbol lock event, and upon initiating a symbol lock event, identifying symbols which contribute to an award configuration, locking identified symbols; and, updating remaining symbols for display.

The symbol lock event is initiated when symbols for display in predefined symbol display positions include a matching symbol.

The identified symbols contribute at least partially to an award configuration in combination with at least one of the symbols in the predefined symbol display positions.

The method further comprises evaluating the symbols for display to determine whether to make an award, and to make any determined award.

The matching symbol is a wild symbol.

Symbols are for display in a matrix of symbols including rows and columns.

The predefined symbol display positions comprise a column.

The symbols are positioned on a reel.

The predefined display positions comprise symbols of a single reel.

The award configuration is a predefined pattern of symbols for display.

The method for use of an electronic gaming server further comprises generating a symbol lock event at a predefined position in a game sequence, the symbols being updated in a symbol update and the game sequence comprising a predetermined number of symbol updates.

In yet another aspect the invention provides an electronic method of gaming comprising a gaming server machine comprising selecting a plurality of symbols from a symbol set for display on a client device, evaluating the symbols for display to determine whether to initiate a symbol lock event, and upon initiating a symbol lock event, identifying symbols which contribute to an award configuration, locking identified symbols, and, updating remaining symbols for display.

The symbol lock event is initiated when symbols for display in predefined symbol display positions include a matching symbol.

The identified symbols contribute at least partially to an award configuration in combination with at least one of the symbols in the predefined symbol display positions.

The electronic method of gaming further comprises evaluating the symbols for display to determine whether to make an award, and to make any determined award.

The matching symbol is a wild symbol.

Symbols are for display in a matrix of symbols including rows and columns.

The predefined symbol display positions comprising a column.

The symbols are positioned on a reel.

The predefined display positions comprising symbols of a single reel.

The award configuration is a predefined pattern of symbols for display.

The electronic method of gaming further comprises generating a symbol lock event at a predefined position in a game sequence, the symbols being updated in a symbol update and the game sequence comprising a predetermined number of symbol updates.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
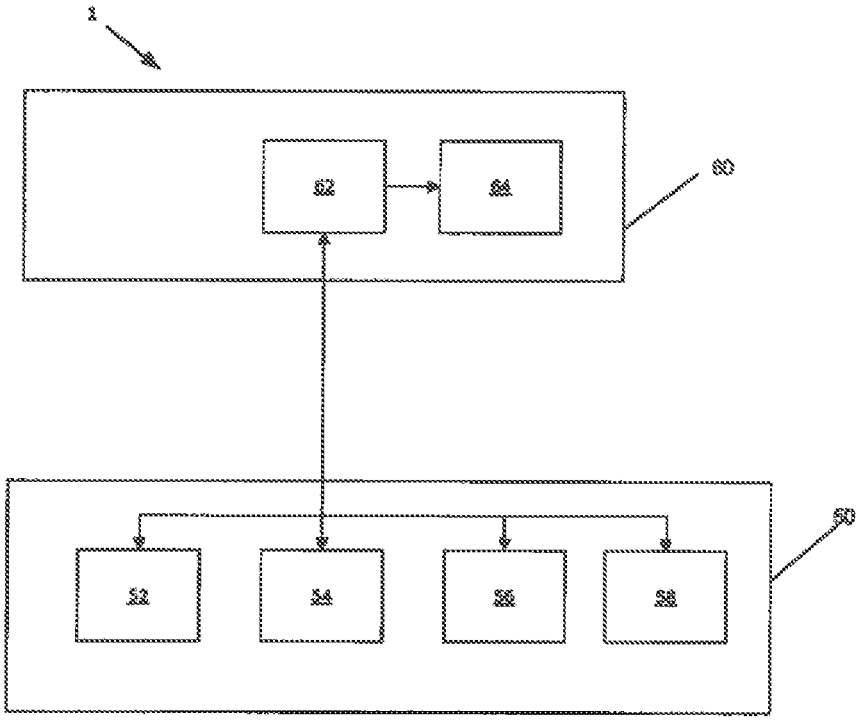
FIG. 1 is a block diagram of the core components of a gaming system.

Referring to the drawings, there is shown an embodiment of an electronic gaming system wherein the symbols of a plurality of predetermined symbol display positions within a symbol display are evaluated to determine whether a symbol lock event should be triggered. When triggered, the electronic gaming system identifies symbols in the symbol display which contribute in combination with symbols in the predetermined symbol display positions to at least part of an award configuration. These symbols and the symbols of the predetermined display positions are locked in a subsequent game.

In a subsequent game the remaining symbols are modified by selecting symbols from a symbol set for display at the respective ones of the symbol display positions. The modified symbol display is evaluated to determine whether to make and award and to make any determined award.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player. The gaming machine could be in the form of many electronic devices including PC, laptop, mobile phone.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system 1 has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
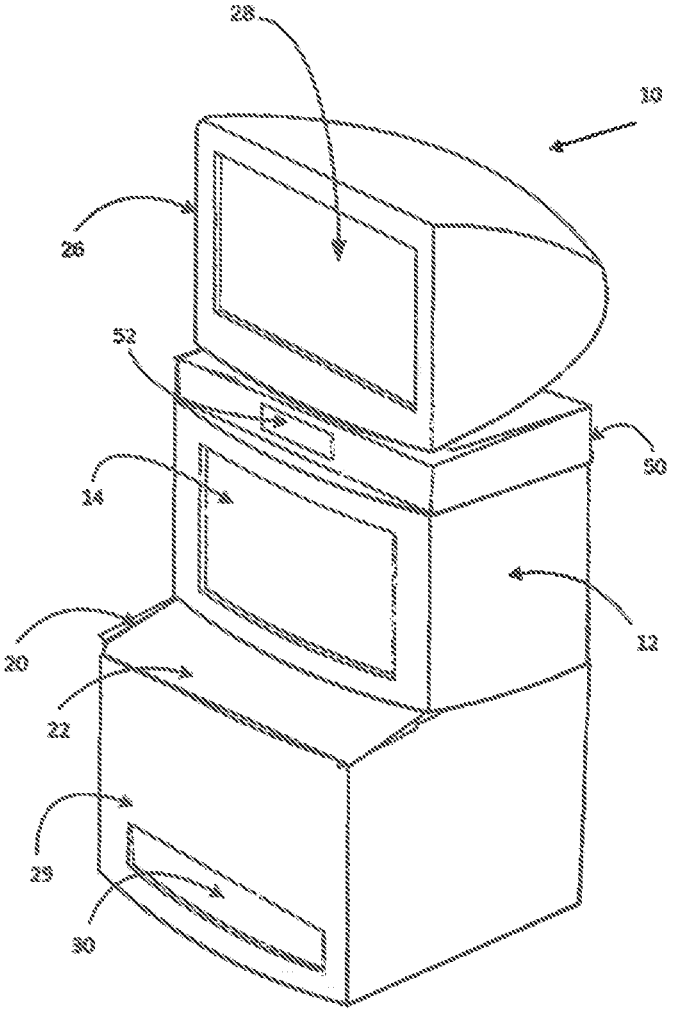
FIG. 2 is a perspective view of a stand alone gaming machine.

A gaming system in the form of a standalone gaming machine 10 is illustrated in FIG. 2. The gaming machine 10 includes a console 12 having a first video display 14. A mid-trim 20 of the gaming machine 10 houses a bank of buttons 22 for enabling a player to interact with the gaming machine, in particular during game play. The video display 14 may also have a touch screen to enable the user to input instructions. The video display 14 shown in FIG. 2 is in the form of a video display unit, particularly a cathode ray tube device. Alternatively, the display 14 may be a liquid crystal display, plasma screen, any other suitable video display unit. The top box 26 has a secondary video which may be of the same type as the display 14, or of a different type.

While not shown in FIG. 2, the mid-trim 20 also typically houses a credit input mechanism such as a coin input chute and a bill collector. FIG. 2 also shows the another credit input mechanism in the form of a player marketing module 50 having a reading device 52 for the purpose of reading a player tracking device, for example as part of a loyalty program. The player tracking device may be in the form of a card, flash drive or any other portable storage medium capable of being read by the reading device. The player marketing module 50 also allows the player to transferring credits to the gaming machine from credits stored on the player tracking device or by transferring credits from a player account in data communication with the player marketing module. Other embodiments of gaming machines may have a ticket reader for reading tickets having a value and crediting the player based on the face value of the ticker.

Artwork and/or information may be provided on a front panel 29 of the console 12. A coin tray 30 is mounted beneath the front panel 29 for dispensing cash payouts from the gaming machine 10.

Figure 3:
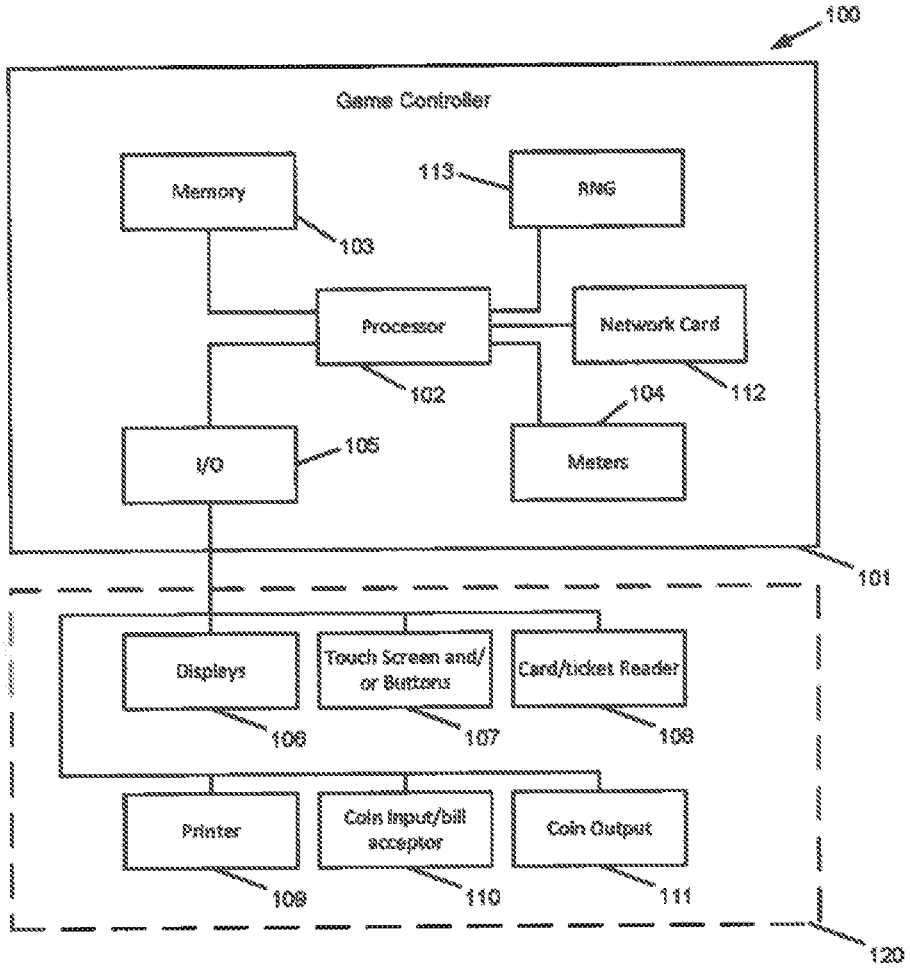
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (110) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
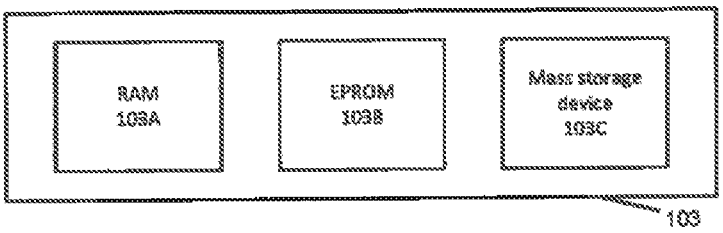
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106, 107, 108, 109, 110, 111 to be provided remotely from the game controller 101.

Figure 5:
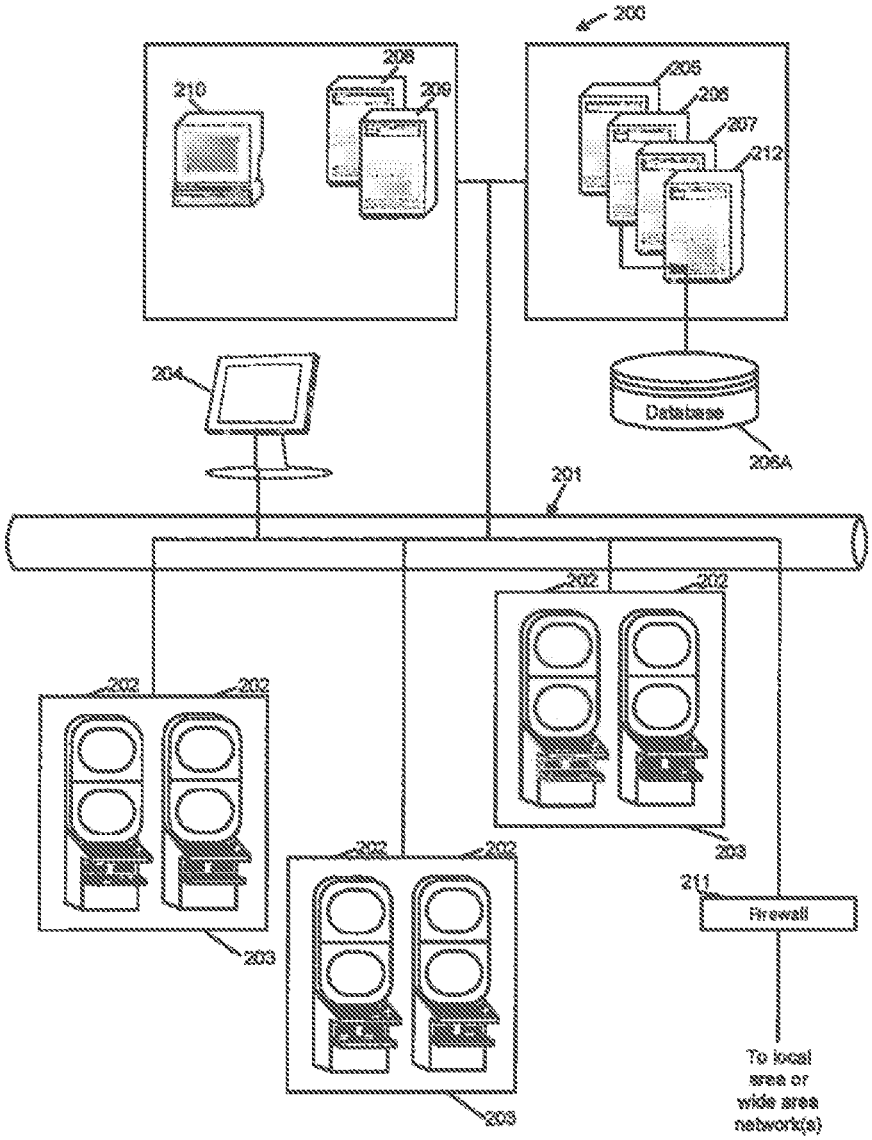
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5 are connected to the network 201. The gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The player operates the game play mechanism 56 to specify a wager and hence the win entitlement which will be evaluated for this play of the game and initiates a play of the game. Persons skilled in the art will appreciate that a player's win entitlement will vary from game to game dependent on player selections. In most spinning reel games, it is typical for the player's entitlement to be affected by the amount they wager and selections they make (i.e. the nature of the wager). For example, a player's win entitlement may be based on how many lines they play in each game—e.g. a minimum of one line up to the maximum number of lines allowed by the game (noting that not all permutations of win lines may be available for selection) and how much they wager per line. Such win lines are typically formed by a combination of symbol display positions, one from each reel, the symbol display positions being located relative to one another such that they form a line.

In many games, the player's win entitlement is not strictly limited to the lines they have selected, for example, "scatter" pays are awarded independently of a player's selection of paylines and are an inherent part of the win entitlement.

Persons skilled in the art will appreciate that in other embodiments, the player may obtain a win entitlement by selecting a number of reels to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. As a result, the total number of ways to win is determined by multiplying the number of active display positions of each reel, the active display positions being all display positions of each selected reel and the designated display position of the non-selected reels. As a result for five reels and fifteen display positions there are 243 ways to win.

Figure 6:
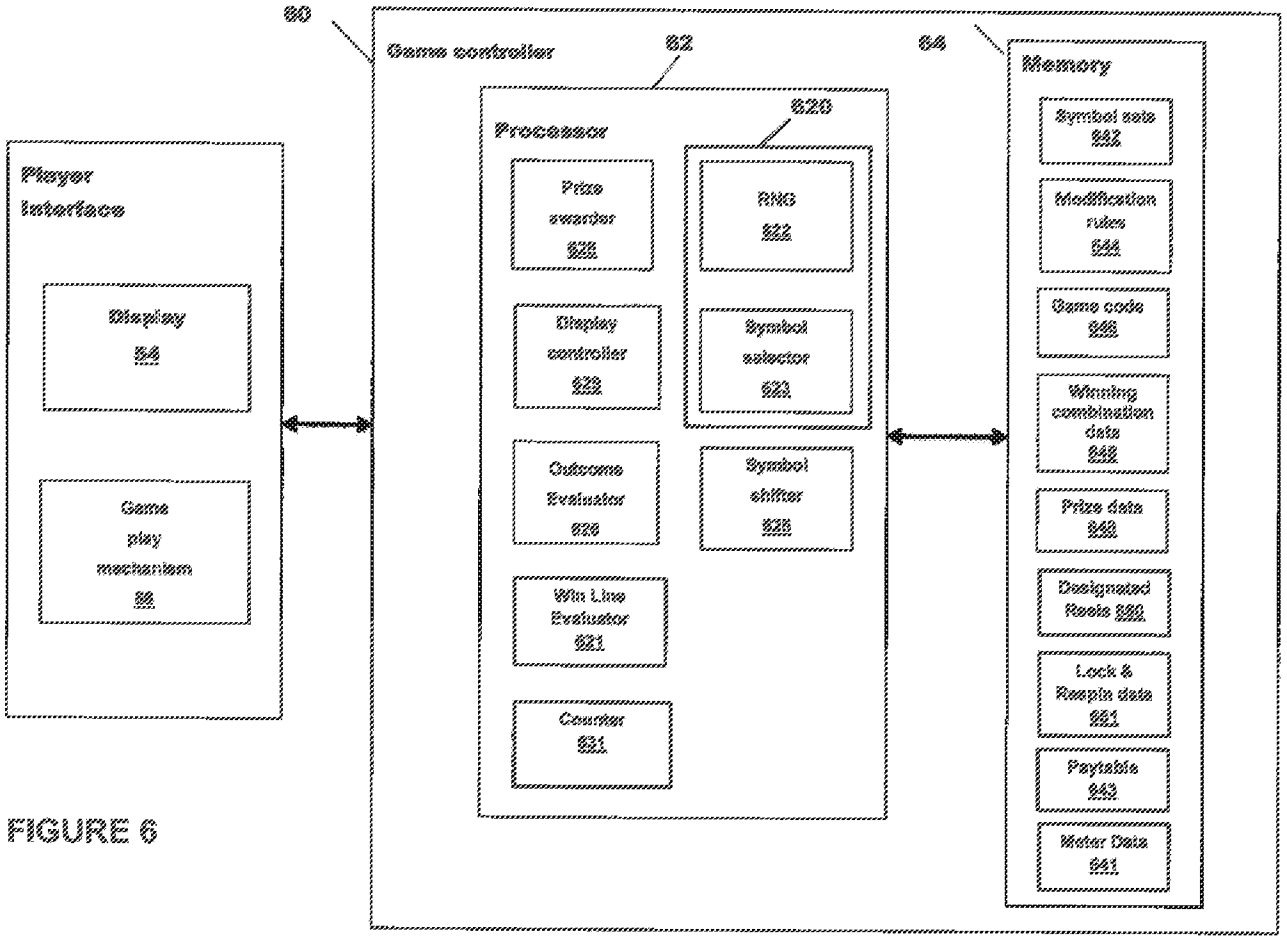
FIG. 6 is a further block diagram of a gaming system.

In FIG. 6, the processor 62 of game controller 60 of gaming system 1 is shown implementing a number of modules based on game program code 646 stored in memory 64. Persons skilled in the art will appreciate that various of the modules could be implemented in some other way, for example by a dedicated circuit.

These modules include the outcome generator 620 which operates in response to the player's operation of game play mechanism 56 to place a wager and initiate a play of the game and generates a game outcome which will then be evaluated by outcome evaluator 626.

The first part of forming the game outcome is for a symbol selector 623 to select symbols from a set of symbols specified by symbol data 642 using random number generator 622 that are to make up a symbol display. The selected symbols are advised to the display controller 629 which causes them to be displayed as a symbol display on display 54 at a set of display positions. If wild symbols are to be incorporated into the final symbol display, in some embodiments this may occur while the reels are spinning. In other embodiments, this may occur as the reels reach their stop positions. In other embodiments, this may occur after the reels have been stopped and the initially selected symbols have been displayed. In some embodiments, some wilds may be added at different times. For example, single wilds and multi-wild symbols may be added as the reels are spinning while the single wilds stemming from the multi-wilds may be added after the reels have been stopped.

In the embodiment described below, the display positions of the symbol display are arranged in a matrix comprising a plurality of columns and a plurality of rows. In the embodiment described below there are more symbols in some columns than other, such as 4-5-6-5-4 arrangement of twenty four display positions. Each display position may have an individual designated reel or multiple display positions may be associated with a common reel. In such arrangements, the columns of four symbols can be arranged so that they are off-set or staggered relative to the columns having five symbols or six symbols so that the middle two symbols in the columns of four symbols share boundaries with two symbols of each neighbouring reel. In further embodiments the symbols may be arranged in a rectangular matrix having a plurality of columns and rows.

In one embodiment, the outcome generator 620 is arranged to generate one or more game outcomes. All outcomes are displayed on video display 54 under control of display controller 629. One example of generating a first game outcome is for the symbol selector 623 to select symbols for display from symbol data in the form of a plurality of symbol sets 642 corresponding to respective ones of a plurality of reels. The symbol sets specify a sequence of symbols for each reel such that the symbol selector 623 can select all of the symbols to be displayed for each reel by selecting a stopping position in the sequence randomly based on a result obtained from random number generator 622. It is known to use a probability table stored in memory 64 to vary the odds of a particular stop position being selected. Other techniques can be used to control the odds of particular outcomes occurring to thereby control the return to player of the game.

In embodiments adjacent symbol display positions may be independent reels or may be a common reel. For example a column may include six symbol display positions which all display symbols from a single reel. This can be referred to as a single strip.

In the embodiment, particular reels within the matrix of the symbol display are designated reels for a symbol lock event. In embodiments the designated reels may form a complete column within the matrix. For example, in the embodiment discussed above having five columns in a 4-5-6-5-4 arrangement of display positions all six positions in the centre column may be designated reels for the symbol lock event. In further embodiments the designated reels may be positioned in different configurations within the reel matrix. Memory 64 stores the positions of the designated reels.

In the embodiment, during a game reels can be locked. When a reel is locked, the symbol displayed on the reel is held for a subsequent game during which reels which are not locked are spun and the display symbol updated. It will be clear to those skilled in the art that when a reel is spun and updated it may or may not display a different symbol depending on the final position of the reel.

Memory 64 includes lock and respin data 651 which defines the symbol combinations required to be displayed on the designated reels in order to trigger a respin event. In embodiments a lock and respin event is triggered when all designated reels display the same symbol. In further embodiments the lock and respin data requires alternative combinations of symbols on the designated reels to trigger a lock and respin event.

In a game, outcome evaluator 626 retrieves the positions of the designated reels 650 from memory 64 and retrieves the lock and respin data 651 to identify the symbols required to be displayed on the designated reels to trigger a respin event. Outcome evaluator then evaluates the symbols displayed on the designated reels 650 and compares these symbols with the lock and respin data. If the outcome evaluator 626 determines that the symbols displayed on the designated reels match those required to trigger a lock and respin event, a lock and respin event is triggered. For example if the designated reels are all six reels of the column having six reels in the 4-5-6-5-4 arrangement discussed above and a lock and respin event is triggered when all designated reels show the same symbol, outcome evaluator evaluates whether the positions in the six reels all show the same symbol. If all six reels display the same symbol a lock and respin event is triggered. If the reels do not display the same symbol a lock and respin event is not triggered.

In an embodiment, in the event that a lock and respin event is not triggered all reels are spun in a subsequent game. As discussed above, symbol selector 623 selects symbols from the set of symbols specified by symbol data 642 to be displayed on each reel.

In an embodiment, memory 64 includes winning combination data 648. Winning combination data specifies the positions of symbols within the display corresponding to all possible win line combinations within the game. When a lock and respin event is triggered win line evaluator 621 retrieves winning combination data 648 from memory 64. Win line evaluator evaluates the symbol display 629 and compares the symbol display with winning combination data 648. Win line evaluator identifies any complete or partial win lines within symbol display 629 which incorporate at least one designated reel. For example, in the arrangement 4-5-6-5-4 a win line may require five identical symbols arranged in a horizontal line on adjacent reels across the reel matrix. Win line evaluator evaluates the symbol display and identifies any symbols displayed in the symbol display at positions corresponding to the win line. In the event where the symbol display includes five identical symbols on adjacent reels in a horizontal configuration across the symbol display a win line is complete when all five symbols are displayed. In the event where a horizontal line of adjacent reels includes four identical symbols and one different symbol across the symbol display and one of the reels showing an identical symbol is the designated reel a partial win line is created. This is not a complete win line since five identical symbols are required. A further horizontal line may only include one symbol which matches the corresponding designated reel. Again this is a partial win line.

In the next game following a lock and respin event, all reels which contribute to a partial win line are locked and maintain their symbols and all designated reels are locked also maintaining their symbols. The locked symbols are held and these reels are not spun. All remaining reels are not locked and are spun. Symbol selector 623 selects symbols from the set of symbols specified by symbol data 642 to be displayed on each spun reel.

After the respin, once the symbol display is finalised, it is evaluated by the outcome evaluator 626 to determine whether it includes any winning combinations 648 to determine whether to make an award. Any award is added to the win meter maintained in memory 64 as part of meter data 641. The meter data 641 also includes the current value of a credit meter. The current values of the credit and win meters are displayed on display 54 by the display controller 629. Wins are transferred from the win meter to the credit meter at the end of a play of the game. Wagers are deducted from the credit meter when play of a game commences.

In embodiments, a single lock and respin event may be allowed each time a lock and respin event is triggered. Alternatively, further lock and respin events may continue until a win is generated.

In each game, wild symbols (symbols that substitute for other symbols in winning symbol combinations) may be incorporated into the symbol display. Wild symbols may contribute to any win line and may contribute to trigger a lock and respin event. For example, in an embodiment having six designated reels, if five of the designated reels display the same symbol and the sixth designated reel displays a wild symbol, the wild symbol substitutes as a matching symbol to the other five reels and a lock and respin event is triggered. In further examples having six designated reels lock and respin events are triggered by the designated reels displaying four matching symbols and two wild symbols, three matching symbols and three wild symbols, two matching symbols and four wild symbols, five wild symbols and any other symbol and six wild symbols.

Embodiments of the invention may involve the awarding of a number of additional game rounds in the form of a plurality of free games. As known in the art, the awarding of a number of free games is often referred to as a feature game and the rules for the feature game may be the same or different to the rules of the base game. For example, there may be a change in the composition of the reels for the feature game or a change to the pay table 643 or both.

Embodiments of the invention may form part of a feature game or the base game. In the event that a series of games are allocated to a player, whether due to the wager placed by the player or due to a series of feature games allocated to the player a lock and respin event may be allocated to the player by the system at a particular position within the series. In FIG. 6 counter 631 controls the number of remaining games in a particular series. In an embodiment the final spin of a series of games is a guaranteed lock and respin event. In this embodiment in the final game of the series the symbols in the designated positions are replaced with wild symbols to trigger a lock and respin event. For example, in a series of ten games, for the tenth game the designated reel positions, for example the centre column, all display wild symbols and a lock and respin event is triggered.

In this respect it will be appreciated that the game controller 62 conducts the game based on game rule data.

Figure 7:
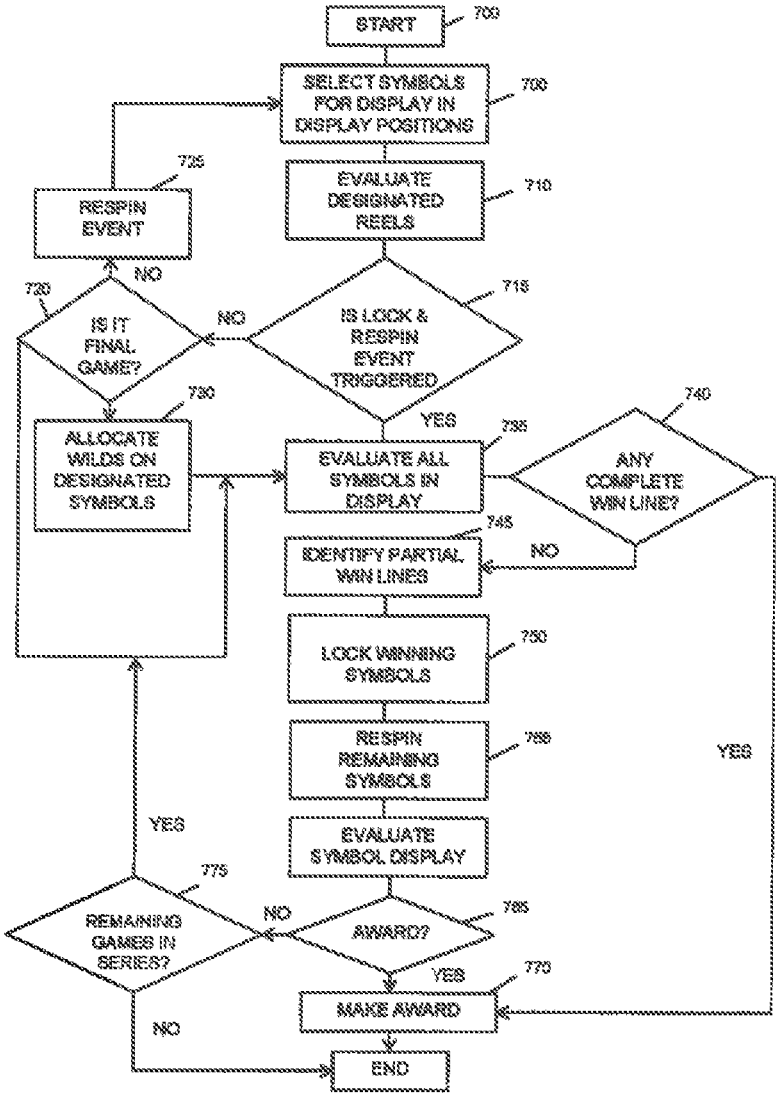
FIG. 7 is a flow chart of an embodiment.

Referring now to FIG. 7, a method 700 of an embodiment is summarised with respect to a flowchart. When the game starts 700, the outcome generator selects 705 symbols for display on the display. The outcome generator independently evaluates 710 the designated reels of the display and identifies whether a lock and respin event is triggered at 715.

If a lock and respin event is not triggered, in embodiments the counter determines 720 whether it is the final game in a series. If not, a full respin event is triggered 725. Alternatively, if it is the final game of the series a full stack of wild symbols are allocated 730 to each designated reel and a lock and respin event is triggered.

The outcome evaluator evaluates 735 all symbols in the display and determines 740 whether any win lines are completed. If yes the system makes an award. Alternatively, the outcome evaluator identifies 745 any partial win lines including symbols in combination with at least one symbol of a designated reel. The designated symbols are locked and the reels of partial win lines are locked 750.

The remaining reels are respun 755 and the outcome evaluator evaluates 760 the symbol display to identify any win lines and identify if any awards are due to the player. If any awards are due the award is made 770. Alternatively the counter determines 775 whether any games are remaining in the series. If so, the system may allocate a further lock and respin event or conduct a full respin of all reels. In an embodiment, if only a single game remains in the series it allocates 730 wild symbols to all designated reels and triggers a lock and respin event.

EXAMPLES

Figure 8:
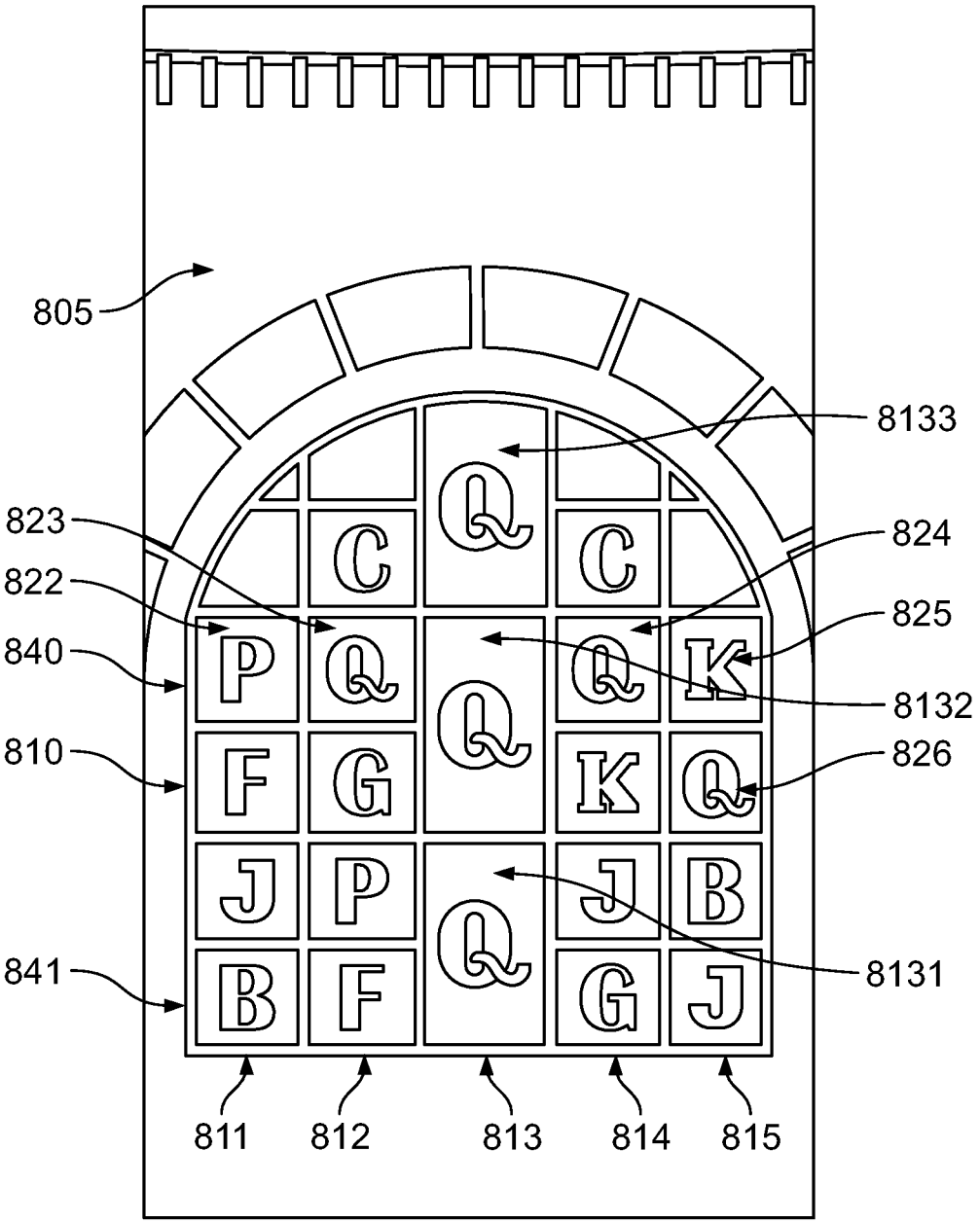
FIG. 8 is an illustration of a game in accordance with a first embodiment.

An example of an embodiment of the invention is illustrated in FIG. 8.

FIG. 8 shows a video display 54 including an animation 805 and a series of symbol positions 810. The symbol positions are arranged in a matrix having five columns 811, 812, 813, 814, 815. In the example of FIG. 8 column 811 includes 4 symbol positions, column 812 includes 5 symbol positions, 813 includes 3 symbol positions, column 814 includes 5 symbol positions and 815 includes 4 symbol positions. The symbols of column 813 are larger than those of the other columns.

Each symbol position in columns 811, 812, 814, 815 is an individual reel and is spun independently. Column 813 includes three symbols from a single reel. The centre reel is a single strip while the other 18 reels are independently spun reels. Each reel includes multiple symbols. In total the matrix includes 21 symbol display positions and 19 reels (the centre column is a single reel).

In the example of FIG. 8 the designated display positions used to trigger a lock and respin event are the three display positions of centre column 813, namely 8131, 8132, 8133. In the example of FIG. 8 each of these positions shows the same symbol, i.e. the queen. In the example of FIG. 8 the matching symbols in each of the designated positions triggers a lock and respin event.

Once the lock and respin event is triggered the outcome evaluator identifies whether any win lines exist in the matrix which include at least one of the queens on the centre reel, the centre reel being composed of the three designated display positions. In the example of FIG. 8 a win line requires a full horizontal line of matching symbols across the matrix. No full win lines are provided which include one of the queens from column 813. For example, the display positions of horizontal row 840 includes (from left to right) prince symbol 822, queen symbol 823, queen symbol 8332, queen symbol 824, knife symbol 825.

Since no full win lines are displayed, outcome evaluator identifies any symbols in evaluation columns 811, 812, 814, 815 which could potentially contribute to a win line. In FIG. 8 the queens of 823, 824, 826 could all contribute to potential win lines in combination with the queens of column 813. The queens of column 813 and queens 823, 824 and 826 are all held for the next spin. The reels for all remaining symbols of the display are spun in the next game and the queens are locked.

After the respin if, for example, the symbols of prince 822 and knife 825 are replaced with queens, then a win line is created at row 840. Alternatively if the reels of row 841 are all replaced with queens then row 841 provides a win line.

Although win lines in the example of FIG. 8 have been described as horizontal rows showing matching characters, it will be clear to those skilled in the art that win lines could be provided by any combination of symbols depending on the particular game, for example diagonal lines or other combinations of symbols.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

In the above embodiment, a series of free games or free spins is awarded. In some embodiments, there may be other types of game rounds awarded such as re-spins where some reels are held while other reels are re-spun. A game round involves at least one of the reels being "spun"—e.g. new symbols of the reels are selected for display at the display positions and the reel is either physically or virtually spun to a stop. Persons skilled in the art will appreciate that there may be more than one game round in a play of a gaming machine such as is the case when a series of free spins is awarded. The outcome of a game round may be no win, a win (for example from a winning combination of symbols), a contribution towards a win accrued over a plurality of game rounds, a trigger condition occurring etc. Typically, a win will result in some form of award being made such as an award of credits. Such an award may never actually be physically received by a player. For example, many gaming systems provide a player with a double or nothing gamble feature, where the player can double or forfeit their credits before commencing another play of the game or cashing out. Further, as credits are fungible, once credits have been added to the credit meter it is not possible to distinguish between credits which exist because the player has input cash or the like and credits resulting from an award.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art will appreciate that program code provides a series of instructions executable by the processor.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. An electronic gaming machine, comprising:

a video display; and a game controller configured to execute instructions stored in a memory, which when executed by the game controller, cause the game controller to at least;

prior to a first spin of a game comprising a plurality of winning combinations, designate at least one reel from a plurality of reels as a designated reel and other reels from the plurality of reels as non-designated reels;

after designating the at least one reel as the designated reel, spin and stop the plurality of reels to display a first plurality of symbols at a plurality of symbol display positions of the video display such that a first non-designated reel presents a first symbol along a win line, a second non-designated reel presents a second symbol along the win line, and the designated reel presents a third symbol along the win line, wherein the second non-designated reel presents the second symbol along the win line between the first symbol and the third symbol;

initiate an event in response to the first plurality of symbols displaying a combination of symbols associated with the event; and in response to initiating the event:

lock the first non-designated reel and the designated reel to define a plurality of locked reels that are not spun per a subsequent spin of the plurality of reels and a plurality of unlocked reels that are spun per the subsequent spin of the plurality of reels in response to determining that at least one winning combination of the plurality of winning combinations includes the first symbol and the third symbol but not the second symbol; and after locking the first non-designated reel and the designated reel, spin the plurality of reels, including the second non-designated reel, to update symbol display positions of the plurality of unlocked reels with a second plurality of symbols.

2. The electronic gaming machine of claim 1, wherein the designated reel presents symbols for a column of symbol display positions in the plurality of symbol display positions and each non-designated reel presents a symbol for a single symbol display position in the plurality of symbol display positions.

3. The electronic gaming machine of claim 2, wherein, when executed, the instructions further cause the game controller to initiate the event in response to determining that the designated reel displays a same symbol in all symbol display positions of the column of symbol display positions.

4. The electronic gaming machine of claim 1 wherein the plurality of reels comprises:

a first plurality of non-designated reels that display a first column of symbols in a first column of symbol display positions of the plurality of symbol display positions; and a second plurality of non-designated reels that display a second column of symbols in a second column of symbols display positions of the plurality of symbol display positions.

5. The electronic gaming machine of claim 4, wherein the designated reel consists of a single reel that displays a third column of symbols in a center column of symbol display positions of the plurality of symbol display positions.

6. The electronic gaming machine of claim 4, wherein the at least one winning combination of symbols comprises a predefined pattern of symbols that includes a symbol from each reel of the plurality of reels.

7. The electronic gaming machine of claim 1, wherein, when executed, the instructions further cause the game controller to:

award a series of plays of the game;

for each play of the game in the series, spin and stop the plurality of reels to display symbols in the plurality of symbol display positions of the video display; and for a final play of the game in the series, populate each symbol display position of the designated reel with a predetermined symbol so that the event is initiated during the final play of the game in the series regardless of an outcome of spinning and stopping the plurality of reels for the final play of the game.

8. The electronic gaming machine of claim 1, wherein the instructions, when executed, cause the game controller to:

award a series of plays of the game;

for each play of the game in the series, spin and stop the plurality of reels to display symbols in the plurality of symbol display positions of the video display; and for a final play of the game of the series, replace symbols that are displayed by the designated reel with wild symbols to trigger the event for the final play of the game in the series regardless of an outcome of the spinning and stopping of the plurality of reels for the final play of the game.

9. The electronic gaming machine of claim 1, further comprising:

a credit input device; and a credit output device; wherein the instructions further cause the game controller to:

establish a credit balance in response to receiving a physical item representing a monetary value via the credit input device, the credit balance being increasable and decreasable based on wager activity; and cause the credit output device to dispense an item representing the monetary value of the credit balance in response to receipt of a cash out input.

10. A non-transitory computer-readable storage medium having computer-executable instructions embodied thereon, which when executed by a computing device, cause the computing device, in response to initiating a game, to, at least:

display, on a video display of the computing device, a plurality of reels providing a plurality of symbol display positions, wherein a reel from the plurality of reels is a designated reel for all spins of the game and a plurality of reels from the plurality of reels are non-designated reels for all spins of the game;

spinning and stopping the plurality of reels to display a first plurality of symbols at the plurality of symbol display positions of the video display, wherein the first plurality of symbols include a first symbol presented along a win line by a first non-designated reel, a second symbol presented along the win line by a second non-designated reel, and a third symbol presented along the win line by the designated reel, wherein the second symbol is presented along the win line between the first symbol and the third symbol; and in response to the first plurality of symbols displaying a predetermined combination of symbols:

lock the reels presenting the first symbol and the third symbol to define a plurality of locked reels that are not spun per a subsequent spin of the plurality of reels and a plurality of unlocked reels, including the reel presenting the second symbol, that are spun per the subsequent spin of the plurality of reels in response to determining that the designated reel along with one or more non-designated reels present a partial winning combination of symbols along the win line, wherein the partial winning combination of symbols includes the first symbol and the third symbol; and after locking the first non-designated reel and the designated reel, spin the plurality of reels to update symbol display positions of the plurality of unlocked reels with a second plurality of symbols.

11. The non-transitory computer-readable storage medium of claim 10, wherein the designated reel presents symbols for a column of symbol display positions in the plurality of symbol display positions and each non-designated reel presents a symbol for a single symbol display position in the plurality of symbol display positions.

12. The non-transitory computer-readable storage medium of claim 11, wherein, the predetermined combination of symbols includes a same symbol in all symbol display positions of the column of symbol display positions corresponding to the designated reel.

13. The non-transitory computer-readable storage medium of claim 10 wherein the plurality of reels comprises:

a first plurality of non-designated reels that display a first column of symbols in a first column of symbol display positions of the plurality of symbol display positions; and a second plurality of non-designated reels that display a second column of symbols in a second column of symbols display positions of the plurality of symbol display positions.

14. The non-transitory computer-readable storage medium of claim 12, wherein the designated reel consists of a single reel that displays a third column of symbols in a center column of symbol display positions of the plurality of symbol display positions.

15. The non-transitory computer-readable storage medium of claim 10, wherein the instructions, when executed, cause the computing device to:

for each play of the game in a series of games, spin and stop the plurality of reels to select the first plurality of symbols from a symbol set for the game; and in response to a final play of the game in the series, replace symbols that are displayed by the designated reel with wild symbols to trigger an event associated with the predetermined combination of symbols for the final play of the game.

16. A method comprising:

prior to a first spin of a game, designating a reel from a plurality of reels of an electronic gaming machine as a designated reel and a plurality of reels from the plurality of reels as non-designated reels;

after designating the reel as the designated reel, spinning and stopping the plurality of reels, via a processor of the electronic gaming machine, to display a first plurality of symbols in columns of symbol display positions such that a first non-designated reel presents a first symbol along a win line, a second non-designate reel presents a second symbol along the win line, and the designated reel presents a third symbol along the win line, wherein the win line passes through at least one symbol display position from each column of symbol display positions, and wherein the second non-designated reel presents the second symbol along the win line between the first symbol and the third symbol; and in response to the first plurality of symbols displaying a predetermined combination of symbols:

in response to determining that the designated reel along with one or more of the non-designated reels present, along the win line, a partial winning combination of symbols that includes at least the first symbol and the third symbol, locking the designated reel and one or more non-designated reels that present the partial winning combination to define a plurality of locked reels, including at least the designated reel and the first non-designated reel, that retain their respective symbols and a plurality of unlocked reels, including at least the second non-designated reel, that update their respective symbols per a subsequent spin of the plurality of unlocked reels; and after locking the first non-designated reel and the designated reel, spinning the plurality of unlocked reels, including the second non-designated reel, to update symbol display positions of the plurality of unlocked reels with a second plurality of symbols.

17. The method of claim 16, wherein the designated reel presents symbols for a column from the columns of symbol display positions and each non-designated reel presents a symbol for a single symbol display position in the columns of symbol display positions.

18. The method of claim 17, wherein, the predetermined combination of symbols includes a same symbol in all symbol display positions of the column of symbol display positions corresponding to the designated reel.

19. The method of claim 16, wherein the plurality of reels comprises:

a first plurality of non-designated reels that display a first column of symbols in a first column of symbol display positions from the columns of symbol display positions; and a second plurality of non-designated reels that display a second column of symbols in a second column of symbols display positions from the columns of symbol display positions.

20. The method of claim 18, wherein the designated reel consists of a single reel that displays a third column of symbols in a center column of symbol display positions from the columns of symbol display positions.

* * * * *